US006267391B1

(12) United States Patent
Dodge

(10) Patent No.: US 6,267,391 B1
(45) **Date of Patent: *Jul. 31, 2001**

(54) SNOWBOARD BOOT BINDING MECHANISM

(75) Inventor: David J. Dodge, Shelburne, VT (US)

(73) Assignee: The Burton Corporation, Burlington, VT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/313,138

(22) Filed: May 17, 1999

Related U.S. Application Data

(63) Continuation of application No. 08/674,976, filed on Jul. 3, 1996, now Pat. No. 5,941,555, which is a continuation of application No. 08/375,971, filed on Jan. 20, 1995, now abandoned.

(51) Int. Cl.[7] ..... A63C 9/00

(52) U.S. Cl. ..... 280/14.22; 280/624; 280/613; 36/117.1

(58) Field of Search ..... 280/14.2, 11.12, 280/11.3, 600, 611, 613, 623, 624, 625, 633, 634, 635, 636, 14.22; 36/117.1, 117.3, 120, 121

(56) References Cited

U.S. PATENT DOCUMENTS

| | | |
|---|---|---|
| Re. 26,972 | 10/1970 | Spademan . |
| Re. 33,350 | 9/1990 | Stuart . |
| 3,271,040 | 9/1966 | Spademan . |
| 3,560,011 | 2/1971 | Spademan . |
| 3,578,349 | 5/1971 | Edmund . |
| 3,775,875 | 12/1973 | Dvorsky . |
| 3,884,492 | 5/1975 | Spademan . |
| 3,887,206 | 6/1975 | Salomon . |
| 3,900,204 | 8/1975 | Weber . |

(List continued on next page.)

FOREIGN PATENT DOCUMENTS

| | | |
|---|---|---|
| 255325 | 7/1961 | (AT) . |
| 678494A5 | 9/1991 | (CH) . |
| 682133A5 | 7/1993 | (CH) . |
| 9413356.5 | 12/1994 | (DE) . |
| 0059022 | 9/1982 | (EP) . |
| 350 411 A2 | 1/1990 | (EP) . |
| 0398794 | 11/1990 | (EP) . |
| 712 646 A1 | 5/1996 | (EP) . |
| 2148501 | 3/1973 | (FR) . |
| 2689776 | 10/1993 | (FR) . |
| 7-303728 | 11/1995 | (JP) . |
| WO96/05894 | 2/1996 | (WO) . |
| WO96/26774 | 6/1996 | (WO) . |

OTHER PUBLICATIONS

Galde AG Snowboard Safety Binding (Advertisement and translation).

English Translation of JP 7–303728 (related to DE 94 13 356.5) International Search Report.

Family Search of Derwent World Patent Index.

*Primary Examiner*—J. J. Swann
*Assistant Examiner*—James S. McClellan
(74) *Attorney, Agent, or Firm*—Wolf, Greenfield & Sacks, P.C.

(57) ABSTRACT

A snowboard boot binding mechanism includes a base member having a recessed channel. The first plate is slidably attached to the base member. A first pair of engagement rods are fixedly attached to the first plate. Each of the first pair of engagement rods has a head disposed at an axial end of the rod for selectively engaging and locking a fist bar attached to a first side of the snowboard boot. A second plate is fixedly attached to the base member. A second pair of engagement rods are fixedly attached to the second plate. Each of the second pair of engagement rods have a head disposed at an axial end of the rod for engaging and locking a second bar attached to a second side of the snowboard boot which is disposed opposite of the first side.

97 Claims, 4 Drawing Sheets

U.S. PATENT DOCUMENTS

| | | | | |
|---|---|---|---|---|
| 3,964,758 | | 6/1976 | Kent . | |
| 3,964,761 | | 6/1976 | Syrovatka . | |
| 3,988,841 | | 11/1976 | Salomon . | |
| 4,026,045 | | 5/1977 | Druss . | |
| 4,042,257 | | 8/1977 | Salomon . | |
| 4,063,752 | | 12/1977 | Whitaker et al. . | |
| 4,145,071 | | 3/1979 | Salomon . | |
| 4,168,085 | | 9/1979 | Faulin . | |
| 4,177,584 | | 12/1979 | Beyl . | |
| 4,261,595 | | 4/1981 | Smialowski et al. . | |
| 4,415,176 | | 11/1983 | Hull et al. . | |
| 4,536,006 | | 8/1985 | Haldemann et al. . | |
| 4,652,007 | | 3/1987 | Dennis . | |
| 4,657,277 | | 4/1987 | Haldemann et al. . | |
| 4,728,116 | | 3/1988 | Hill . | |
| 4,735,845 | | 4/1988 | Haldemann et al. . | |
| 4,741,550 | | 5/1988 | Dennis . | |
| 4,964,649 | | 10/1990 | Chamberlain . | |
| 4,973,073 | | 11/1990 | Raines et al. . | |
| 5,035,443 | | 7/1991 | Kincheloe . | |
| 5,054,807 | | 10/1991 | Fauvet . | |
| 5,131,675 | | 7/1992 | Haldemann et al. . | |
| 5,188,386 | | 2/1993 | Schweizer . | |
| 5,190,311 | * | 3/1993 | Carpenter et al. | 280/618 |
| 5,299,823 | | 4/1994 | Glaser . | |
| 5,417,443 | | 5/1995 | Blattner et al. . | |
| 5,474,322 | | 12/1995 | Perkins et al. . | |
| 5,505,478 | | 4/1996 | Napoliello . | |
| 5,520,405 | * | 5/1996 | Bourke | 280/613 |
| 5,520,406 | | 5/1996 | Anderson et al. . | |
| 5,595,396 | | 1/1997 | Bourdeau . | |
| 5,690,351 | | 11/1997 | Karol . | |
| 5,722,680 | | 3/1998 | Dodge . | |
| 5,755,046 | * | 5/1998 | Dodge | 280/613 |
| 5,799,966 | | 9/1998 | Haldemann . | |
| 5,971,420 | | 10/1999 | Okajima . | |

* cited by examiner

SNOWBOARD BOOT BINDING MECHANISM

This application is a continuation of Ser. No. 08/674,976, filed Jul. 3, 1996, now U.S. Pat. No. 5,941,555 now pending, which is a continuation of Ser. No. 08/375,971, filed Jan. 20, 1995, now abandoned, which is hereby incorporated herein by reference.

BACKGROUND OF THE INVENTION

1. Field of the Invention

The present invention relates generally to boot binding mechanisms. More specifically, the present invention relates to a snowboard boot binding mechanism that has a pair of engagement rods fixedly attached to a fixed plate and a second pair of engagement rods fixedly attached to a slidably movable plate to selectively engage and lock a snowboard boot in the boot binding mechanism.

2. Description of the Related Art

A recently popular sport, snowboarding presents operating conditions and physical demands to boot bindings that are somewhat dissimilar to other skiing-type sports. That is because in snowboarding, the operator stands with both feet on the snowboard such that both feet are typically disposed at an angle with respect to the longitudinal direction of the ski. Given the sophisticated structure of presently manufactured boots for ski-type sports and the operating conditions the boots are subject to, a reliable and tight connection in between the boot and the snowboard is required.

An attempted solution to this problem is disclosed in U.S. Pat. No. 4,973,073 to Raines et al., issued on Nov. 27, 1990. The boot sole 40 of Raines is modified to have a binding ridge 42, 50 placed on each side of the boot. Ridge 42 is received in a fixed entrapment member 60 and ridge 50 is received by a pivoting entrapment member 70. To release a bound boot 18, the user simply pushes the handle 102 away from the boot until the hooking lip 76 is in an open position and the second binding bridge 50 can be lifted out of the second socket 72. Accordingly, during use the snowboard binding can be rather easily inadvertently opened if handle 102 or any part of member 70 is accidentally pushed away from the boot.

U.S. Pat. No. 4,063,752 to Whittaker issued on Dec. 20, 1977 discloses a ski binding that includes two opposing latch members 28 that each move towards and away from each other to control the latch operation. An engagement plate 32 is secured to the bottom of the boot by screws and has latch receiving formations 34 disposed at its marginal edges.

Notwithstanding the foregoing boot binding mechanisms, there are still major problems involved. The binding mechanisms are typically mounted on the ski or snowboard and are disposed in such a manner that outside forces can easily cause an accidental release of the binding mechanism. Accordingly, it is an object of the present invention to provide a snowboard boot binding mechanism that permits selective engagement and locking of the snowboard boot while simultaneously preventing an inadvertent release of the boot from the locked position. It is a further object of the present invention to provide a boot binding mechanism that includes a base member which acts as a housing to enclose most of the moving parts of the boot binding mechanism to thereby minimize the risk of an accidental release of the binding from the locked position. It is a further object to provide a boot binding mechanism that permits the binding mechanism to clamp the boot sole from the side, i.e., from the in-step area of the foot. It is a further object to provide a snowboard boot binding mechanism that requires less parts and thus, is smaller and easier to manufacture. It is still a further object of the present invention that the snowboard boot binding mechanism be simple and cost effective to manufacture, yet reliable and efficient in use.

SUMMARY OF THE INVENTION

In accordance with a preferred embodiment demonstrating further objects, features and advantages of the invention, a snowboard boot binding mechanism includes a base member having a recessed channel. A first plate is slidably attached to the base member. A first pair of engagement rods are fixedly attached to the first plate. Each of the first pair of engagement rods have a head disposed at an axial end of the rod for selectively engaging and locking a first bar attached to a first side of the snowboard boot. A second plate is fixedly attached to the base member. A second pair of engagement rods are fixedly attached to the second plate. Each of the second pair of engagement rods having a head disposed at an axial end of the rod for engaging and locking a second bar attached to a second side of the snowboard boot which is disposed opposite to the first side.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EMBODIMENTS

Figure 1:
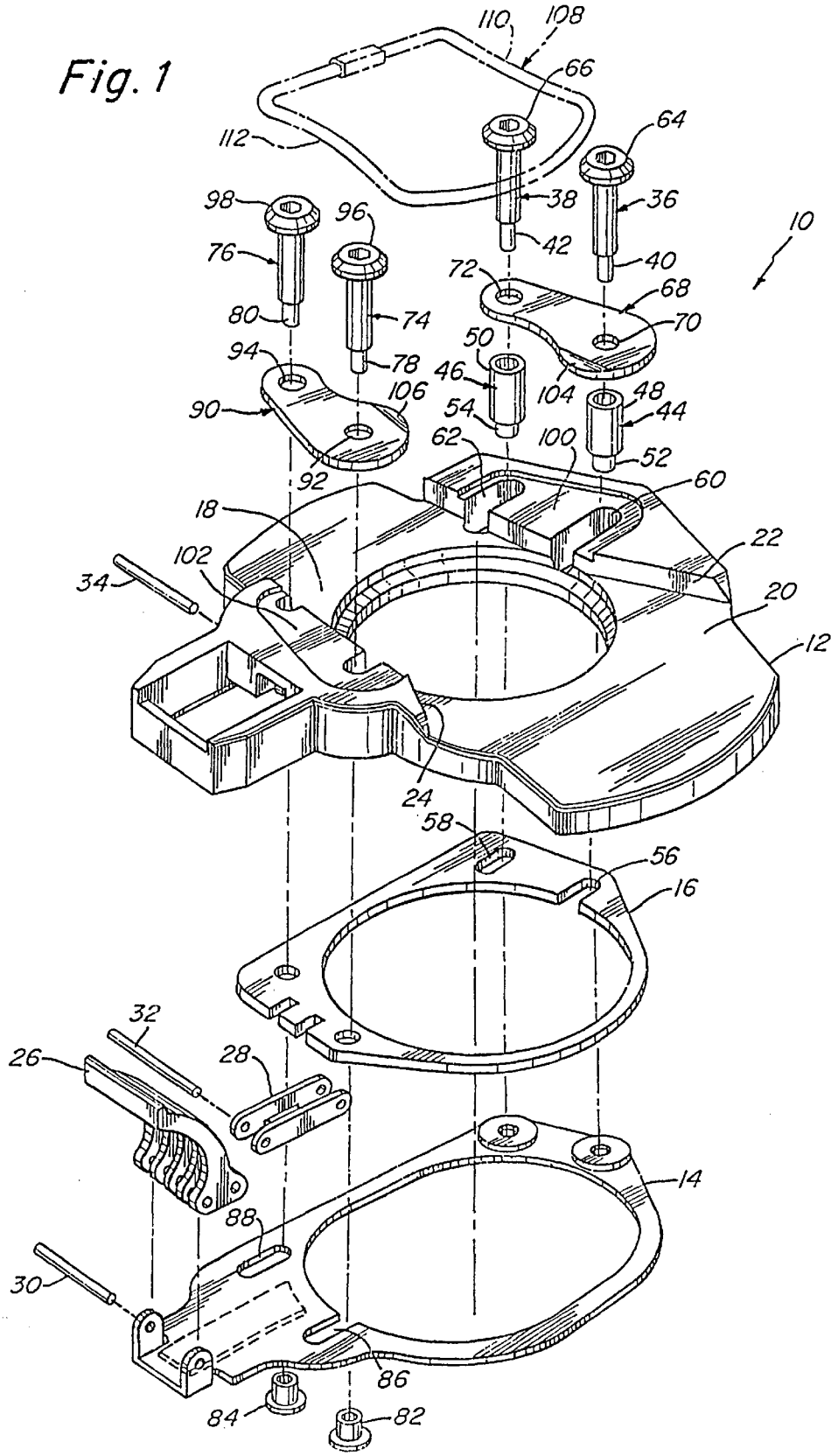
FIG. 1 is an exploded view of the boot binding mechanism according to the present invention.

Referring now to FIG. 1, a snowboard boot binding mechanism 10 is illustrated. The boot binding mechanism includes a base member 12, a first plate 14 and a second plate 16. The base member 12 has a recessed channel 18 that includes an upper surface 20 and two sidewalls surfaces 22, 24 to receive a snowboard boot.

The first plate 14 is slidably attached to base member 12 through a pivoting handle member 26 and pivoting link arm member 28. A pin 30 is used to pivotally connect handle member 26 to first plate 14. A second pin 32 is used to pivotally connect handle member 26 to link 28. The opposite end of link 28 is pivotally connected to base member 12 by pin 34.

A first pair of engagement rods 36, 38 are fixedly attached to first plate 14. The rods 36, 38 are integrally connected to first plate 14 at their lower axially ends 40, 42, respectively; it being understood that relative orientation adjectives such as "upper", "lower", etc. are utilized herein to simplify the present description and are not intended to limit the orientation of the binding mechanism when mounted for use. The rods 36, 38 are preferably connected to plate 14 by riveting. However, any other suitable mean fixedly attaching the rods to the plate may be used. Each rod 36, 38 passes through a spacer sleeve 44, 46, respectively. Each spacer sleeve 44, 46 has a stepped outer diameter portion including a larger diameter position, 48, 50 and a smaller diameter portion 52, 54, respectively. The smaller diameter portions 52, 54 arc received in elongated slots 56, 58, respectively in second plate 16, whereas the larger diameter portions 44, 46 are received in elongated slots 60, 62, respectively, in the base member 12. The upper axially ends of the rods 36, 38 have a head or plate-shaped portion 64, 66. An engagement plate 68 has a pair of throughholes 70, 72 to receive the larger diameter portions of rods 36, 38. Thus, engagement plate 68 is disposed about engagement rods 36, 38 and between head portions 64, 66 and spacer sleeves 44, 46. The spacer sleeves are utilized to help absorb some of the bending forces that may be applied against rods 36, 38. Additionally, engagement plate 68 is used to help transfer some of the bending forces that may be applied to rods 36, 38 into tensile forces. Of course, axial forces in rods 36, 38 are preferred over bending forces.

Figure 2A:
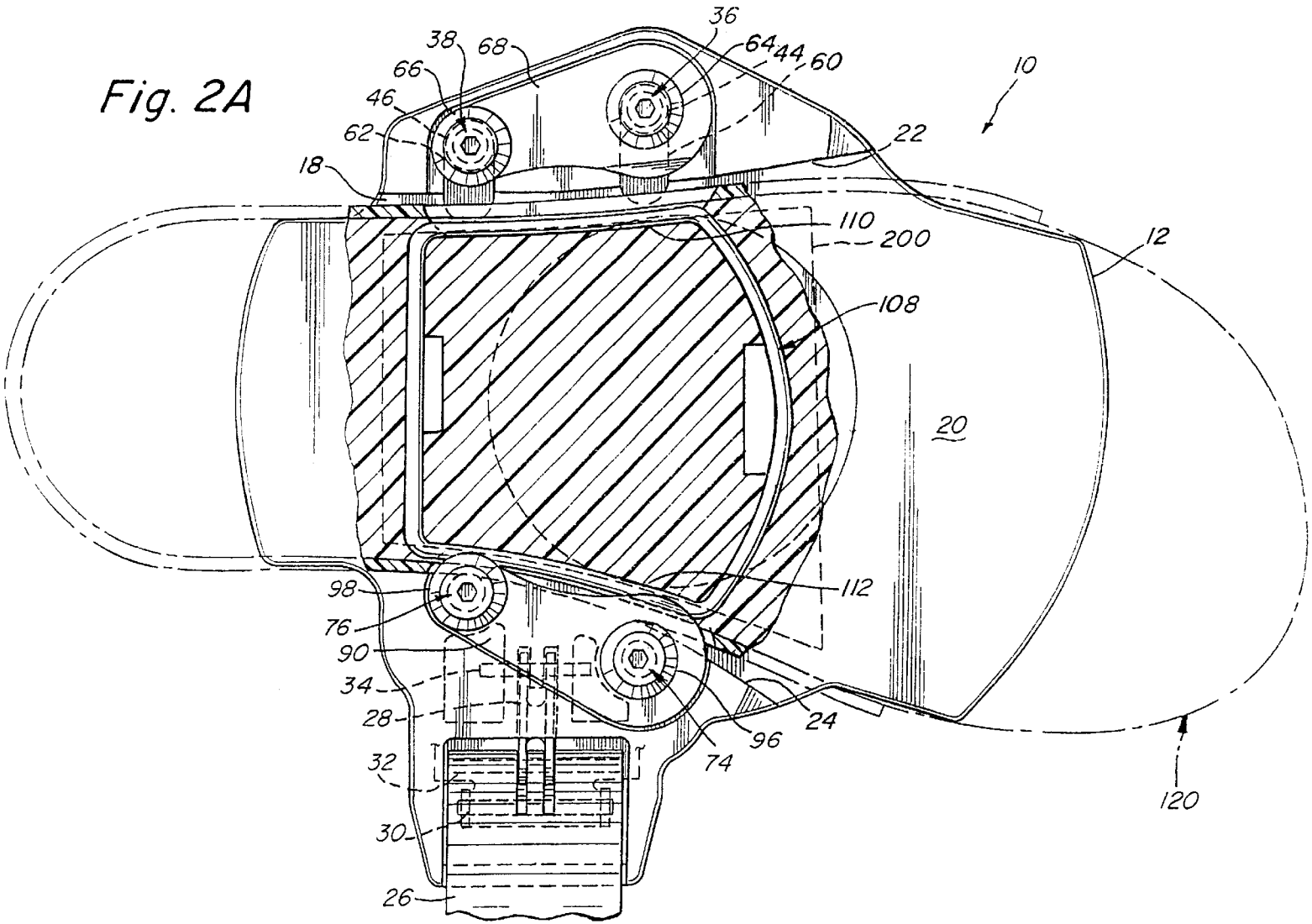
FIG. 2A is a partial sectional top view of an alternative embodiment of the snowboard boot disposed in the boot binding mechanism and in the unlocked position.
Figure 3:
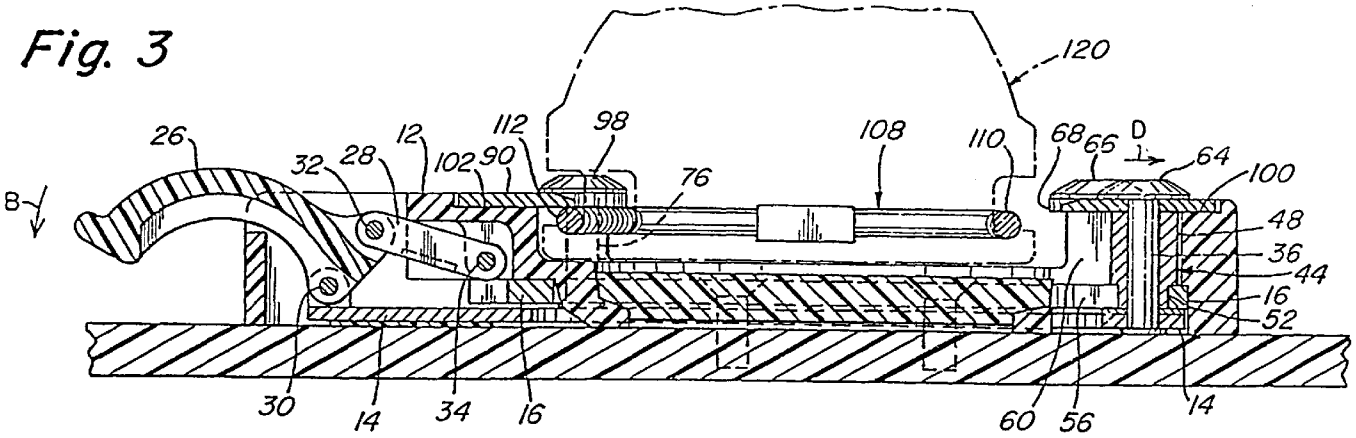
FIG. 3 is a sectional view taken along lines 3—3 of FIG. 2 and looking in the direction of the arrows.
Figure 4:
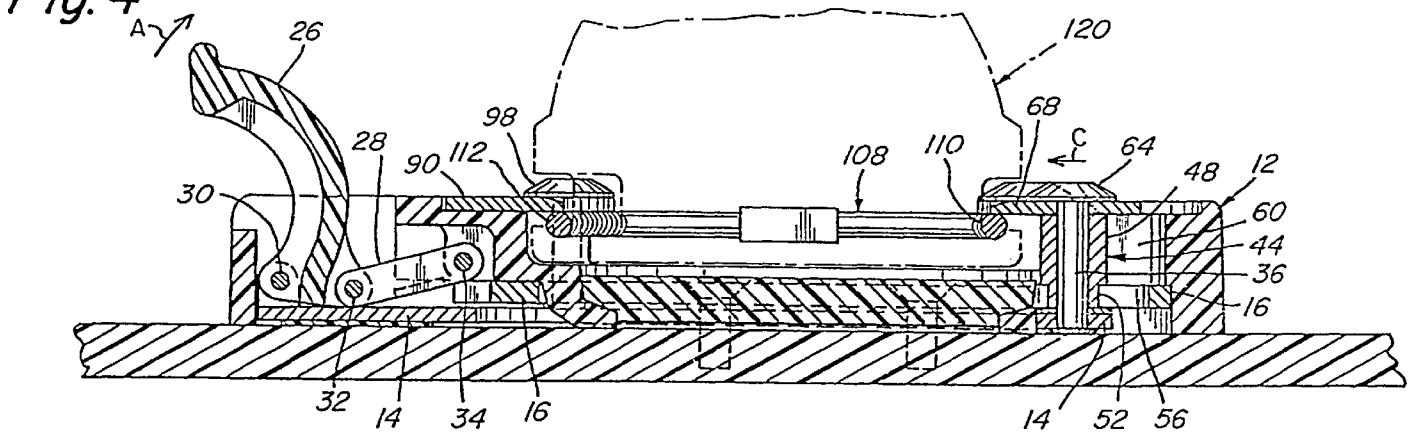
FIG. 4 is a sectional view similar to FIG. 3 except that the boot binding mechanism is in the locked position.

A second pair of engagement rods 74, 76 are fixedly attached to second plate 16 in a similar manner in which the first pair of engagement rods 36, 38 are fixedly attached to the first plate 14. The pairs of engagement rods are preferably fixedly attached to the plates by a press fit. However, any suitable manner of fixedly attaching these two members together such as welding, shrink-fitting, etc. may be used. The lower ends 78, 80, respectively of the second pair of engagement rods 74, 76 have a reduced diameter portion which are sized to fit within a pair of shoulder bushings 82, 84. The shoulder bushings 82, 84 help guide a sliding motion of the first plate 14 because they are received in elongated slots 86, 88, respectively. A second engagement plate is mounted about the second pair of engagements rods 74, 76 via their respective throughholes 92, 94. Engagement plate 90 is mounted just below the heads 96, 98 of the engagement rods 74, 76, respectively. Engagement plate 68 is slidably supported on a slightly recessed, substantially planner surface 100 in base member 12. Likewise, engagement plate 90 is slidably supported on a slightly recessed, substantially planer support surface 102. Plates 68, 90, also have bevelled edge portions 104, 106 to permit a bar member 108, which is in the form of a closed loop and is embedded in a sole of snowboard boot, to more easily engage into a position below plate 68, 90. Bar member 108 has at least two exposed side portions 110, 112, which correspond to the in-step area of the user's foot. Bar member 108 may alternatively not be embedded in the sole, but may be connected to the sole of the snowboard boot see (FIG. 2A), with or without a reinforcing plate 200 (see FIG. 2A) depending on the stresses that will be applied to the bar. Side portions 110, 112 are exposed at least along their upper surface, as illustrated in FIGS. 3 and 4 so that the upper portion of the side 110 can be selectively engaged with the first pair of engagement rods 36 and 38 such that the head portions 64, 66 and the engagement plate 68 lock the boot in the binding mechanism as illustrated in FIG. 5. The opposite side 112 of the bar member 108 is exposed along its upper surface to permit head portions 96, 98 of the second pair of engagement rods 74, 76 and engagement plate 90 to engage and to lock the snowboard boot in the binding mechanism when the first plate is in the locked position as illustrated in FIG. 4.

Figure 2:
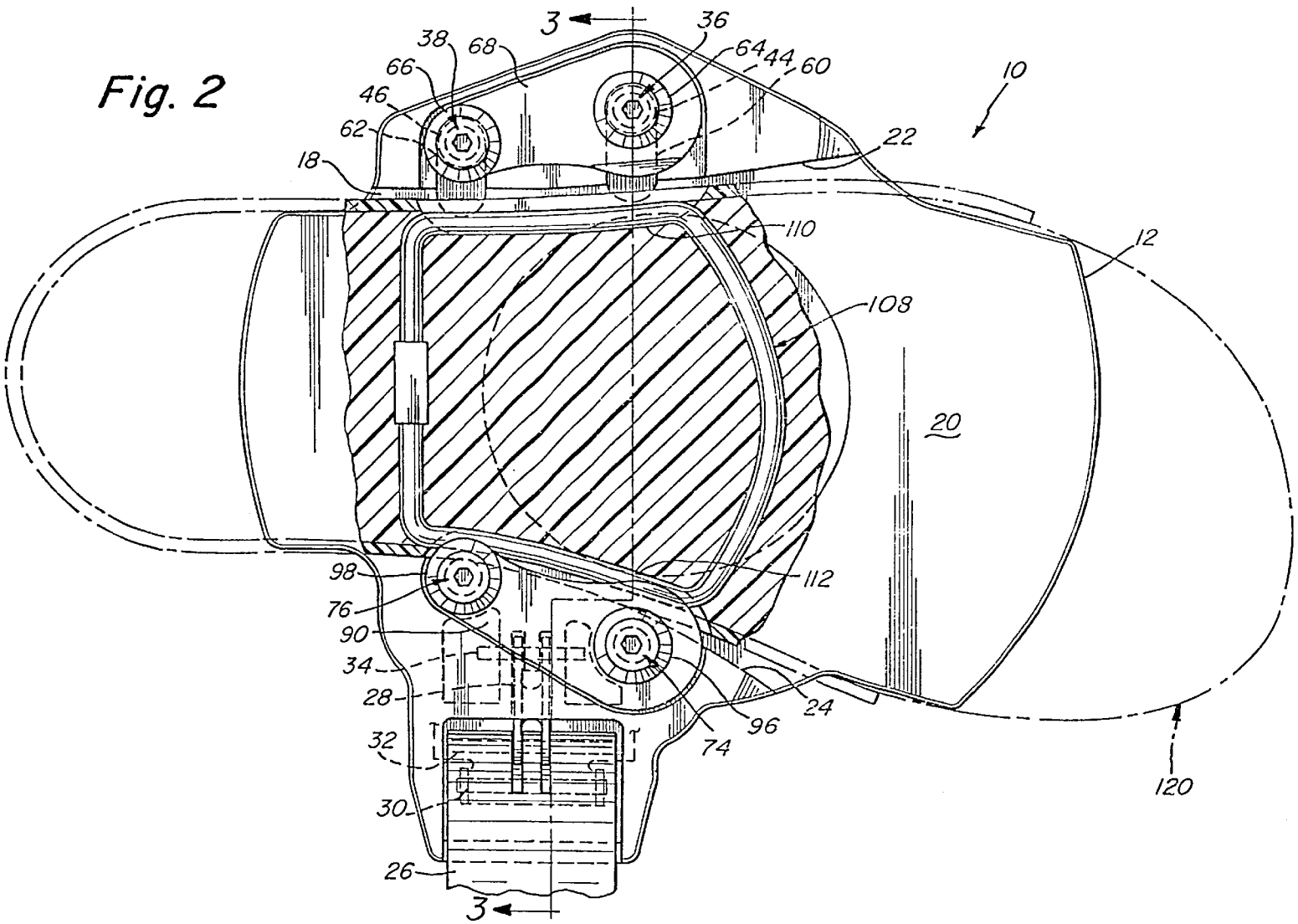
FIG. 2 is a partial sectional top view of a snowboard boot engaged in the boot binding mechanism and in the unlocked position.

The operation of the boot binding mechanism will be described below with reference to FIGS. 2–4. A user wearing a snowboard boot 120 having a closed loop bar member 108 embedded in its sole steps within the open binding mechanism and positions the second side 112 of the bar member 108 into the engaged position below heads 96, 98 and below engagement plate 90 as illustrated in FIGS. 2 and 3.

To lock the boot within the binding mechanism the user then pulls upwardly on handle member 26 in the direction indicated by arrow A in FIG. 4. This upper movement of handle member 26 causes handle member 26 to rotate in the direction indicated by arrow A and to translate in a direction indicated by arrow C in FIG. 4. At the same time, link member 28 pivots about fixed pin 34 in the direction indicated by arrow B, which is opposite to the direction of arrow A. Additionally, simultaneously with the pivoting movements, first plate 14 is slidably moved in the direction indicated by arrow C from the open position as illustrated in FIG. 3 to the closed position as illustrated in FIG. 4. As can be seen in FIGS. 3 and 4, as handle member 26 is pivoted in the upward position, pivot pin 30 slides in the direction indicated by arrow C. When pin 32 passes over an imaginary line extending between pins 30, 34, the handle reaches what is known as a centered position. In this centered position the handle is instable and the handle will then tend to snap into the closed position as illustrated in FIG. 4. In the closed position, the handle is in what is known as an over-centered position. The first set of engagement rods 36, 38 are moved from the open position as illustrated in FIG. 3 to the closed position as illustrated in FIG. 4, such that the heads 64, 66 and the engagement plate 68 selectively engage and lock the first side 10 of the bar member 108 in the boot binding mechanism. If desired, a conventional latch (not shown) may be placed onto handle member 26 to further prevent an inadvertent pivoting of the handle member. However, in most cases the pressure applied from the boot and the base member will be sufficient to maintain the handle in the stable, over-centered position illustrated in FIG. 4.

To unlock the boot, the user simply pushes down and rotates handle member 26 in the direction indicated by arrow B in FIGS. 3. Because of the linkage mechanism, this movement will cause handle member 26 to rotate in the direction indicated by arrow B and to translate in the direction indicated by arrow D. Thus, because of the link between the first plate 14 and the handle member 26, the second plate 14 is slidably moved in the direction indicated by arrow D to the open position as illustrated in FIG. 3. The user can now simply step out of the boot binding mechanism.

Having described the presently preferred exemplary embodiment of a new and improved snowboard boot binding mechanism, in accordance with the present invention, it is believed that other modifications, variations and changes will be suggested to those skilled in the art in view of the teachings set forth below. It is, therefore, to be understood that all such variations, modifications, and changes are believed to fall within the scope of the present invention as defined by the appended claims.

What is claimed is:

1. In a snowboard binding for securing a snowboard boot to a snowboard, the snowboard binding including a base and an engagement apparatus adapted to non-automatically releasably engage a first side of the snowboard boot when the binding is in a closed configuration, the engagement apparatus comprising:

a pair of engagement members supportable by the base, the pair of engagement members including first and second spaced apart engagement members adapted to separately engage first and second sections of the first side of the snowboard boot, while being spaced from a third section of the first side of the snowboard boot disposed therebetween to non-automatically releasably secure the boot, the second engagement member being disposed rearwardly of the first engagement member, the second engagement member being adapted to engage an instep area of the snowboard boot; and a handle mechanically coupled to the pair of engagement members, wherein the handle is pivoted in a first direction to close the binding, and wherein the engagement apparatus is constructed and arranged so that when the binding is closed, forces generated by the snowboard boot that tend to move the pair of spaced apart engagement members toward an open position tend to move the handle in the first direction.

2. The engagement apparatus of claim 1, wherein the pair of engagement members includes an open configuration and a closed configuration respectively corresponding to open and closed positions of the binding, wherein the handle is pivotally mounted relative to the base, and wherein the binding is constructed and arranged so that when the handle is pivoted downwardly toward the base, the pair of space apart engagement members is moved toward the open configuration.

3. The engagement apparatus of claim 2, wherein each of the first and second spaced apart engagement members is arranged to engage the instep area of the snowboard boot.

4. The engagement apparatus of claim 2, in combination with the binding, wherein the first and second engagement members each is movably mounted to the base, and wherein the first and second engagement members are the only moveable engagement members on the binding adapted to engage the snowboard boot.

5. The combination of claim 4, wherein each of the first and second spaced apart engagement members is arranged to engage the instep area of the snowboard boot.

6. The combination of claim 5, wherein the first and second engagement members each is movably mounted to the base, and wherein the pair of spaced apart engagement members is constrained to move, relative to the base, together as a single unit, such that the first and second engagement members are not independently movable relative to the base.

7. The combination of claim 6, in combination with the snowboard boot.

8. The combination of claim 7, wherein the snowboard boot includes an interface disposed at the first side of the snowboard boot, and wherein the pair of engagement members is adapted to engage the interface to secure the snowboard boot to the binding.

9. The combination of claim 8, wherein the first side of the snowboard boot has at least one opening, and the pair of engagement members is adapted to be received within the at least one opening when the binding is in a closed configuration.

10. The combination of claim 9, wherein the at least one opening has a lower wall that terminates substantially in-line with the first side of the snowboard boot.

11. The combination of claim 10, wherein the snowboard boot includes a plate disposed in the instep area of the boot to reinforce the instep area.

12. The combination of claim 11, wherein the snowboard includes a sole having a stiffener disposed therein at the instep area of the boot, the stiffener not extending forward of the instep area so as to not impact flexibility of the sole forward of the instep area.

13. The engagement apparatus of claim 1, wherein the engagement apparatus is free of an engagement member to engage the snowboard boot forward of the instep area of the snowboard boot.

14. The engagement apparatus of claim 1, in combination with the snowboard binding, wherein the first and second engagement members each is movably mounted to the base, and wherein the first and second engagement members are the only moveable engagement members on the binding adapted to engage the snowboard boot.

15. The engagement apparatus of claim 14, further comprising a fixed engagement member adapted to engage a second side of the snowboard boot opposite the first side.

16. The engagement apparatus of claim 1, wherein the first and second engagement members each is movably mounted to the base, and wherein the pair of spaced apart engagement members is constrained to move, relative to the base, together as a single unit, such that the first and second engagement members are not independently movable relative to the base.

17. The engagement apparatus of claim 16, wherein the pair of spaced apart engagement members are part of a unitary component.

18. The engagement apparatus of claim 1, in combination with the snowboard boot.

19. The combination of claim 18, wherein the snowboard boot includes an interface disposed at the first side of the snowboard boot, and wherein the pair of engagement members is adapted to engage the interface to secure the snowboard boot to the binding.

20. The combination of claim 19, wherein the interface is embedded in a sole of the snowboard boot.

21. The combination of claim 19, wherein the interface is attached to a sole of the snowboard boot without being embedded therein.

22. The combination of claim 19, wherein the pair of spaced apart engagement members is arranged to engage, from above, at least a portion of the interface to resist lifting forces generated on the snowboard boot.

23. The engagement apparatus of claim 19, wherein each of the first and second spaced apart engagement members is arranged to engage the instep area of the snowboard boot.

24. The engagement apparatus of claim 23, in combination with the binding, wherein the first and second engagement members each is movably mounted to the base, and wherein the first and second engagement members are the only moveable engagement members on the binding adapted to engage the snowboard boot.

25. The engagement apparatus of claim 24, wherein the first and second engagement members each is movably mounted to the base, and wherein the pair of spaced apart engagement members is constrained to move, relative to the base, together as a single unit, such that the first and second engagement members are not independently movable relative to the base.

26. The combination of claim 19, wherein the interface includes a first portion that extends along the first side of the snowboard boot, and wherein the first and second spaced apart engagement members engage the first portion of the interface.

27. The combination of claim 18, wherein the first side of the snowboard boot has at least one opening, and the pair of engagement members is adapted to be received within the at least one opening when the binding is in a closed configuration.

28. The combination of claim 27, wherein the at least one opening has a lower wall that terminates substantially in-line with the first side of the snowboard boot.

29. The combination of claim 28, wherein the snowboard boot includes a sole having a stiffener disposed therein at the instep area of the boot, the stiffener not extending forward of the instep area so as to not impact flexibility of the sole forward of the instep area.

30. The combination of claim 28, wherein the snowboard boot includes a plate disposed in the instep area of the boot to reinforce the instep area.

31. The combination of claim 27, wherein the first engagement member has an engaging portion that is adapted to be disposed within the at least one opening when the binding is in the closed configuration, wherein the engaging portion has a leading edge that is adapted to be disposed most deeply in the at least one opening, and wherein the engaging portion tapers to a wider portion disposed away from the leading edge.

32. The combination of claim 27, wherein the first engagement member has a boot-facing surface that is adapted to be disposed within the at least one opening periphery when the binding is in the closed configuration, and wherein the boot-facing surface is a curved surface.

33. The combination of claim 18, wherein the snowboard boot includes a plate disposed in the instep area of the boot to reinforce the instep area.

34. The combination of claim 18, wherein the snowboard boot includes a sole having a stiffener disposed therein at the instep area of the boot, the stiffener not extending forward of the instep area so as to not impact flexibility of the sole forward of the instep area.

35. The combination of claim 34, wherein the snowboard boot includes a plate disposed in the instep area of the boot to reinforce the instep area.

36. The combination of claim 35, wherein the first side of the snowboard boot has at least one opening, and the pair of engagement members is adapted to be received within the at least one opening when the binding is in a closed configuration.

37. The combination of claim 36, wherein the at least one opening has a lower wall that terminates substantially in-line with the first side of the snowboard boot.

38. The combination of claim 34, wherein the stiffener is embedded in a sole of the snowboard boot.

39. The engagement apparatus of claim 18, wherein each of the first and second engagement members is movably mounted to the base.

40. The combination of claim 18, wherein the first and second spaced apart engagement members are spaced apart along the first side of the snowboard boot.

41. The combination of claim 18, wherein the first and second spaced apart engagement members extend substantially in-line with the first side of the snowboard boot.

42. The engagement apparatus of claim 1, wherein each of the first and second spaced apart engagement members is arranged to engage the instep area of the snowboard boot.

43. The engagement apparatus of claim 42, in combination with the binding, wherein the first and second engagement members each is movably mounted to the base, and wherein the first and second engagement members are the only moveable engagement members on the binding adapted to engage the snowboard boot.

44. The engagement apparatus of claim 43, wherein the first and second engagement members each is movably mounted to the base, and wherein the pair of spaced apart engagement members is constrained to move, relative to the base, together as a single unit, such that the first and second engagement members are not independently movable relative to the base.

45. The engagement apparatus of claim 44, in combination with the snowboard boot.

46. The combination of claim 45, wherein the snowboard boot includes an interface disposed at the first side of the snowboard boot, and wherein the pair of engagement members is adapted to engage the interface to secure the snowboard boot to the binding.

47. The combination of claim 46, wherein the first side of the snowboard boot has at least one opening, and the pair of engagement members is adapted to be received within the at least one opening when the binding is in a closed configuration.

48. The combination of claim 47, wherein the at least one opening has a lower wall that terminates substantially in-line with the first side of the snowboard boot.

49. The combination of claim 48, wherein the snowboard boot includes a plate disposed in the instep area of the boot to reinforce the instep area.

50. The combination of claim 49, wherein the snowboard boot includes a sole having a stiffener disposed therein at the instep area of the boot, the stiffener not extending forward of the instep area so as to not impact flexibility of the sole forward of the instep area.

51. The engagement apparatus of claim 42, wherein each of the first and second engagement members is arranged to engage a medial side of the snowboard boot in the instep area.

52. The engagement apparatus of claim 42, wherein each of the first and second engagement members is arranged to engage a lateral side of the snowboard boot in the instep area.

53. The engagement apparatus of claim 42, wherein each of the first and second engagement members is movably mounted to the base.

54. The engagement apparatus of claim 1, in combination with the binding, wherein the binding further includes at least one additional engagement member that is supported by the base and is adapted to engage a second side of the snowboard boot, opposite the first side, when the binding is in a closed configuration.

55. The engagement apparatus of claim 1, wherein each of the first and second engagement members is movably mounted to the base.

56. The engagement apparatus of claim 1, in combination with the snowboard binding, wherein the binding includes at least first and second sidewalls to receive the snowboard boot.

57. The combination of claim 56, wherein the pair of engagement members is supported by the base at the first sidewall.

58. The combination of claim 56, wherein the handle is disposed at the first sidewall of the binding.

59. The engagement apparatus of claim 1, in combination with the snowboard binding, wherein the base of the binding includes a portion that is adapted to receive a sole of the boot, the portion being substantially foot shaped.

60. The engagement apparatus of claim 1, wherein the handle is adapted to be disposed at a side of the binding.

61. The engagement apparatus of claim 1, further comprising a fixed engagement member adapted to engage a second side of the snowboard boot opposite the first side.

62. The engagement apparatus of claim 1, in combination with the snowboard binding, wherein the binding includes a recessed channel to receive the snowboard boot.

63. The combination of claim 62, wherein the binding includes first and second sidewalls that define the recessed channel, and wherein the pair of engagement members is disposed on the first sidewall raised from a bottom of the recessed channel to engage the first side of the snowboard boot.

64. The combination of claim 63, further in combination with the snowboard boot, wherein the pair of engagement members engages the first side of the snowboard boot at a height above a bottom sole of the snowboard boot.

65. The engagement apparatus of claim 1, further comprising a locking assembly to non-automatically releasably lock the pair of engagement members in a closed position corresponding to the closed configuration of the binding.

66. A system comprising:

a snowboard boot having first and second sides, the first side including at least one opening periphery that defines at least one opening in the first side, the at least one opening periphery having a top surface and a bottom surface;

a binding that includes:

a base adapted to receive the snowboard boot;

a first engagement member supported by the base, the first engagement member being adapted to engage the at least one opening periphery on the first side of the snowboard boot when the binding is in a closed configuration, the first engagement member being adapted to only partially fill the at least one opening on the first side of the snowboard boot to ease engagement of the first engagement member with the at least one opening so that clearance is provided between the first engagement member and the top surface of the opening periphery when the binding is in the closed configuration, wherein the first engagement member includes a pair of engagement members including first and second spaced apart engagement surfaces adapted to separately engage the at least one opening on the first side of the snowboard boot; and a handle connected to the first engagement member, wherein the binding is constructed and arranged so that the handle is pivoted in a first direction to close the binding, and wherein the binding is further constructed and arranged so that when the binding is in the closed configuration, lifting forces generated by the snowboard boot that tend to move the first engagement member toward an open position tend to move the handle in the first direction.

67. The system of claim 66, wherein each of the first and second spaced apart engagement members is arranged to engage an instep area of the snowboard boot.

68. The system of claim 67, wherein the snowboard boot includes an interface disposed at the first side of the snowboard boot, and wherein the pair of engagement members is adapted to engage the interface to secure the snowboard boot to the binding.

69. The system of claim 67, wherein the at least one opening periphery terminates substantially in-line with the first side of the snowboard boot.

70. The combination of claim 69, wherein the snowboard boot includes a sole having a stiffener disposed therein at an instep area of the boot, the stiffener not extending forward of the instep area so as to not impact flexibility of the sole forward of the instep area.

71. The system of claim 66, wherein the first engagement member has an engaging portion that is adapted to be disposed within the at least one opening when the binding is in the closed configuration, wherein the engaging portion has a leading edge that is adapted to be disposed most deeply in the at least one opening, and wherein the engaging portion tapers to a wider portion disposed away from the leading edge.

72. The system of claim 66, further comprising at least one additional engagement member that is supported by the base and is adapted to engage a second side of the snowboard boot, opposite the first side, when the binding is in a closed configuration.

73. In a snowboard binding for securing a snowboard boot to a snowboard, the snowboard binding including a base, an engagement apparatus, comprising:

a first engagement member supportable by the base, the first engagement member being movable between an open position and a closed position respectively corresponding to an open and a closed configuration of the binding, wherein the first engagement member is adapted to engage a first side of the snowboard boot when the binding is in the closed configuration; and a handle mechanically coupled to the first engagement member so that actuation of the handle in a first direction moves the first engagement member from the open position to the closed position, and so that forces generated by the snowboard boot on the binding that tend to move the first engagement member toward the open position when the binding is in the closed configuration tend to move the handle in the first direction.

74. The engagement apparatus of claim 73, wherein the first engagement member includes a pair of engagement surfaces including first and second spaced apart engagement surfaces adapted to separately engage first and second sections of the first side of the snowboard boot while not engaging a third section of the first side of the snowboard boot disposed therebetween.

75. The engagement apparatus of claim 74, wherein each of the first and second spaced apart engagement surfaces is arranged to engage an instep area of the snowboard boot.

76. The engagement apparatus of claim 74, wherein the first engagement surface is disposed forwardly of the second engagement surface and is arranged to engage an instep area of the snowboard boot.

77. The engagement apparatus of claim 74, in combination with the binding, wherein the binding is free of an engagement member to engage the snowboard boot forward of an instep area of the snowboard boot.

78. The engagement apparatus of claim 74, in combination with the binding, wherein the first engagement member is the only moveable engagement member on the binding adapted to engage the snowboard boot.

79. The engagement apparatus of claim 73, in combination with the binding, wherein the binding further includes at least one additional engagement member that is supported by the base and is adapted to engage a second side of the snowboard boot, opposite the first side, when the binding is in the closed configuration.

80. In a snowboard binding for securing a snowboard boot to a snowboard, the snowboard binding including a base and having an open configuration and a closed configuration, a locking apparatus comprising:

a first engagement member mountable to the base for movement between an open position and a closed position respectively corresponding to the open and closed configurations of the binding, the first engagement member being adapted to engage a first lateral side of the snowboard boot when in the closed position; and an over-center locking mechanism that is mechanically coupled to the first engagement member and has an open state and a closed state respectively corresponding to the open and closed configurations of the binding, the over-center locking mechanism being arranged to lock the first engagement member in the closed position when the over-center locking mechanism is in the closed state, the over-center locking mechanism being constructed and arranged such that forces generated by the snowboard boot on the binding that tend to move the first engagement toward the open position when the binding is in the closed configuration act to maintain the over-center locking mechanism in the closed state.

81. The locking apparatus of claim 80, wherein the first engagement member includes a pair of engagement surfaces including first and second spaced apart engagement surfaces adapted to separately engage first and second sections of the first side of the snowboard boot while not engaging a third section of the first side of the snowboard boot disposed therebetween.

82. The locking apparatus of claim 81, wherein each of the first and second spaced apart engagement surfaces is arranged to engage an instep area of the snowboard boot.

83. The locking apparatus of claim 81, wherein the first engagement surface is disposed forwardly of the second engagement surface and is arranged to engage an instep area of the snowboard boot.

84. The locking apparatus of claim 81, in combination with the binding, wherein the binding is free of an engagement member to engage the snowboard boot forward of an instep area of the snowboard boot.

85. The locking apparatus of claim 81, in combination with the binding, wherein the first engagement member is the only moveable engagement member on the binding adapted to engage the snowboard boot.

86. The locking apparatus of claim 80, in combination with the binding, wherein the binding further includes at least one additional engagement member that is supported by the base and is adapted to engage a second side of the snowboard boot, opposite the first side, when the binding is in the closed configuration.

87. The locking apparatus of claim 80, wherein the over-center locking mechanism includes a member that is in compression when the over-center locking mechanism is in the closed state and forces are generated by the snowboard boot on the binding that tend to move the first engagement toward the open position.

88. A system comprising:

a snowboard boot having first and second sides, the snowboard boot including an interface including a first portion extending along the first side of the snowboard boot, the first side including at least one opening periphery that defines at least one opening in the first side; and a binding that includes:

a base adapted to receive the snowboard boot;

a pair of engagement members supported by the base and including first and second spaced apart engagement members adapted to be separately disposed within the at least one opening and to engage first and second sections of the first portion of the interface while being spaced from a third section of the first portion of the interface disposed therebetween; and a handle mechanically coupled to the pair of engagement members, wherein the handle is pivoted in a first direction to close the binding, and wherein the engagement apparatus is constructed and arranged so that when the binding is closed, forces generated by the snowboard boot that tend to move the pair of spaced apart engagement members toward an open position tend to move the handle in the first direction.

89. The system of claim 88, wherein the binding further comprises a fixed engagement member adapted to engage a second portion of the interface disposed on the snowboard boot opposite the first side.

90. The system of claim 89, wherein the first and second portions of the interface each is a bar that is circular in a cross-section taken from the first side of the boot to the second side of the boot.

91. The system of claim 88, wherein the interface is embedded in the sole of the snowboard boot.

92. The system of claim 88, wherein the first and second spaced apart engagement members are spaced apart along the first side of the snowboard boot.

93. The system of claim 88, wherein the first and second spaced apart engagement members extend substantially in-line with the first side of the snowboard boot.

94. The system of claim 88, wherein the first and second spaced apart engagement members each engages in an instep area of the snowboard boot.

95. The system of claim 88, wherein the at least one opening exposes at least a portion of the interface.

96. The system of claim 95, wherein the pair of spaced apart engagement members is arranged to engage, from above, at least a portion of the interface to resist lifting forces generated on the snowboard boot.

97. The system of claim 88, wherein the at least one opening has a lower wall that terminates substantially in-line with the first side of the snowboard boot.

* * * * *